US005282629A

United States Patent [19]

Eckstein

[11] Patent Number: 5,282,629

[45] Date of Patent: Feb. 1, 1994

[54] AUTOMATIC GOLF BALL TEEING APPARATUS

[76] Inventor: Randall S. Eckstein, Rt. 1, Box 116, Tanner, Ala. 35671

[21] Appl. No.: 980,219

[22] Filed: Nov. 23, 1992

[51] Int. Cl.[5] ..... A63B 57/00

[52] U.S. Cl. ..... 273/201

[58] Field of Search ..... 273/201, 202, 33

[56] References Cited

U.S. PATENT DOCUMENTS

| | | | |
|---|---|---|---|
| 1,888,256 | 11/1932 | Baumgartner | 273/201 |
| 2,198,968 | 4/1940 | Jewett | 273/201 |
| 2,295,599 | 9/1942 | Mozel | 273/201 |
| 2,335,280 | 11/1943 | Hogeberg | 273/201 |
| 2,643,883 | 6/1953 | Hogeberg | 273/201 |
| 3,298,694 | 1/1967 | Turnav et al. | 273/201 |
| 3,549,152 | 12/1970 | Gentiluomo | 273/201 |
| 3,778,067 | 12/1973 | Gentiluomo | 273/201 |
| 4,017,087 | 4/1977 | Bruno | 273/201 |
| 4,315,744 | 3/1987 | Diamandis | 273/201 |
| 4,659,081 | 4/1987 | Cook | 273/201 |
| 5,016,886 | 5/1991 | Gould | 273/201 |
| 5,078,401 | 1/1992 | Fehrenbach et al. | 273/201 |

FOREIGN PATENT DOCUMENTS

| | | | |
|---|---|---|---|
| 525751 | 5/1956 | Canada | 273/201 |

*Primary Examiner*—Vincent Millin
*Assistant Examiner*—Steven B. Wong
*Attorney, Agent, or Firm*—Richard C. Litman

[57] ABSTRACT

An automatic golf ball teeing apparatus using a pivot linkage which connects a tee cylinder and an air cylinder. The pivot linkage extends in a first direction approximately orthogonal to a second direction in which the tee cylinder reciprocates. A tee is coupled to the tee cylinder and thus reciprocates with the tee cylinder. The pivot linkage minimizes the height of the automatic golf ball teeing apparatus since the air cylinder is not located axially beneath the tee cylinder.

14 Claims, 5 Drawing Sheets

AUTOMATIC GOLF BALL TEEING APPARATUS

BACKGROUND OF THE INVENTION

1. Field of the Invention

The present invention relates generally to an apparatus for practicing golf and more particularly, to an apparatus for automatically teeing a golf ball. The present invention is especially useful in driving ranges.

2. Description of the Prior Art

Recently, golf has become more and more popular. It is necessary for a player to improve golfing skill by practicing with various clubs repeatedly paying close attention to his or her stance and hand grip. This practice is often executed at a driving range.

At a driving range, each time the player attempts to hit a golf ball, he must first pick up the golf ball from a bucket and place it on a tee. However, there are some disadvantages. For example, it is arduous for the player to pick up the golf ball from the bucket and place it on the tee without breaking his or her stance or grip. It is not good practice for the player, especially for a beginner, to continually adjust his or her stance and hand grip while practicing a golf shot. Moreover, this action could be a great burden for a player having a back or waist problem.

Accordingly, it is desirable for the player to have the golf balls automatically placed on the tee. The prior art discloses numerous automatic golf ball teeing apparatuses used in driving ranges. U.S. Pat. No. 3,549,152 issued Dec. 22, 1970 and U.S. Pat. No. 3,778,067 issued Dec. 11, 1973, both to Joseph A. Gentiluomo, disclose automatic golf ball teeing apparatuses which incorporate a photocell for detecting the presence or the absence of a golf ball on a retractable tee. Each golf ball is delivered by an underground tube to an automatic tee elevating mechanism. U.S. Pat. No. 4,815,744 issued Mar. 28, 1989 to Manolis Diamandis discloses a mechanical golf ball tee apparatus in which the elastic elevating mechanism is switch-activated upon demand of a player. U.S. Pat. No. 5,016,886 issued May 21, 1991 to Bobby J. Gould discloses an automatic golf ball teeing apparatus which uses a vacuum pump. Canadian Patent No. 525,751 issued May 29, 1956 to Bart A. Hogeberg discloses a golf ball teeing apparatus which uses a photocell.

None of the above patents, taken either singularly or in combination, is seen to describe the instant invention as claimed.

SUMMARY OF THE INVENTION

The present invention relates generally to an apparatus for practicing golf and more particularly, to an apparatus for automatically teeing a golf ball.

The apparatus for automatically teeing a golf ball comprises a first passage connected to a second passage. The second passage supplies a golf ball to the first passage. A tee, on which the golf ball is placed, is accommodated in the first passage. A tee cylinder, also accommodated in the first passage and coupled to the tee, reciprocates with the tee inside the first passage. The tee reciprocates between a first position and a second position. The golf ball is supplied from the second passage to the tee when the tee is located at the first position. In the second position, the tee and the golf ball are elevated and ready to be driven. To prevent the second passage from supplying the golf ball to the first passage, the tee cylinder occludes the second passage while reciprocating. The tee cylinder is coupled to one end of a pivot linkage which extends in a direction approximately orthogonal to a direction in which the tee and the tee cylinder reciprocate. A ball detecting device detects whether or not the golf ball is supported by the tee. A tee reciprocating device is coupled to the other end of the pivot linkage. The tee reciprocating device moves the other end of the pivot linkage and reciprocates the tee and the tee cylinder inside said first passage. A control device is coupled to the ball detecting device and the tee reciprocating device. The control device controls the operation of the tee reciprocating device based on a detection result from the ball detecting device. For example, when the golf ball is driven from the tee, the tee automatically moves to the first position so as to receive another golf ball from the second passage and then returns to the second position.

Alternatively, an air cylinder is coupled to the other end of the pivot linkage. The air cylinder moves the other end of the pivot linkage and reciprocates the tee and the tee cylinder inside the first passage. An air line connection coupled to the air cylinder supplies air to the air cylinder and moves the same. A solenoid valve coupled to the air cylinder and the air line connection controls the operation of the air line connection. The control device is coupled to the ball detecting device and the solenoid valve. The control device controls the operation of the solenoid valve based on the detection result from the ball detecting device.

A driving range system comprises a plurality of automatic golf ball teeing apparatuses connected to a monitoring device. The monitoring device monitors the activity of the plurality of golf ball teeing apparatuses. Each of the automatic golf ball teeing apparatus comprises one of the aforementioned apparatuses for automatically teeing a golf ball. In addition, the control device is connected to the monitoring device and signals the monitoring device when a malfunction occurs.

It should be noted that the pivot linkage of the present invention enables an apparatus to be configured which is shorter than the prior art in the direction in which the tee and the tee cylinder reciprocate. Thus, the apparatus can be easily installed under the ground. In addition, the air cylinder and the solenoid valve achieve a precise control over the reciprocating action of the tee and the tee cylinder which makes the apparatus less expensive.

It is a general object of the present invention to provide a novel and useful apparatus for automatically teeing a golf ball which can be more easily installed under the ground than the prior art.

Another object of the present invention is to provide an apparatus for automatically teeing a golf ball which is less expensive than the prior art.

Other objects and further features of the present invention will become apparent from the following detailed description when read in conjunction with the accompanying drawings.

DETAILED DESCRIPTION OF THE PREFERRED EMBODIMENTS

Figure 5:
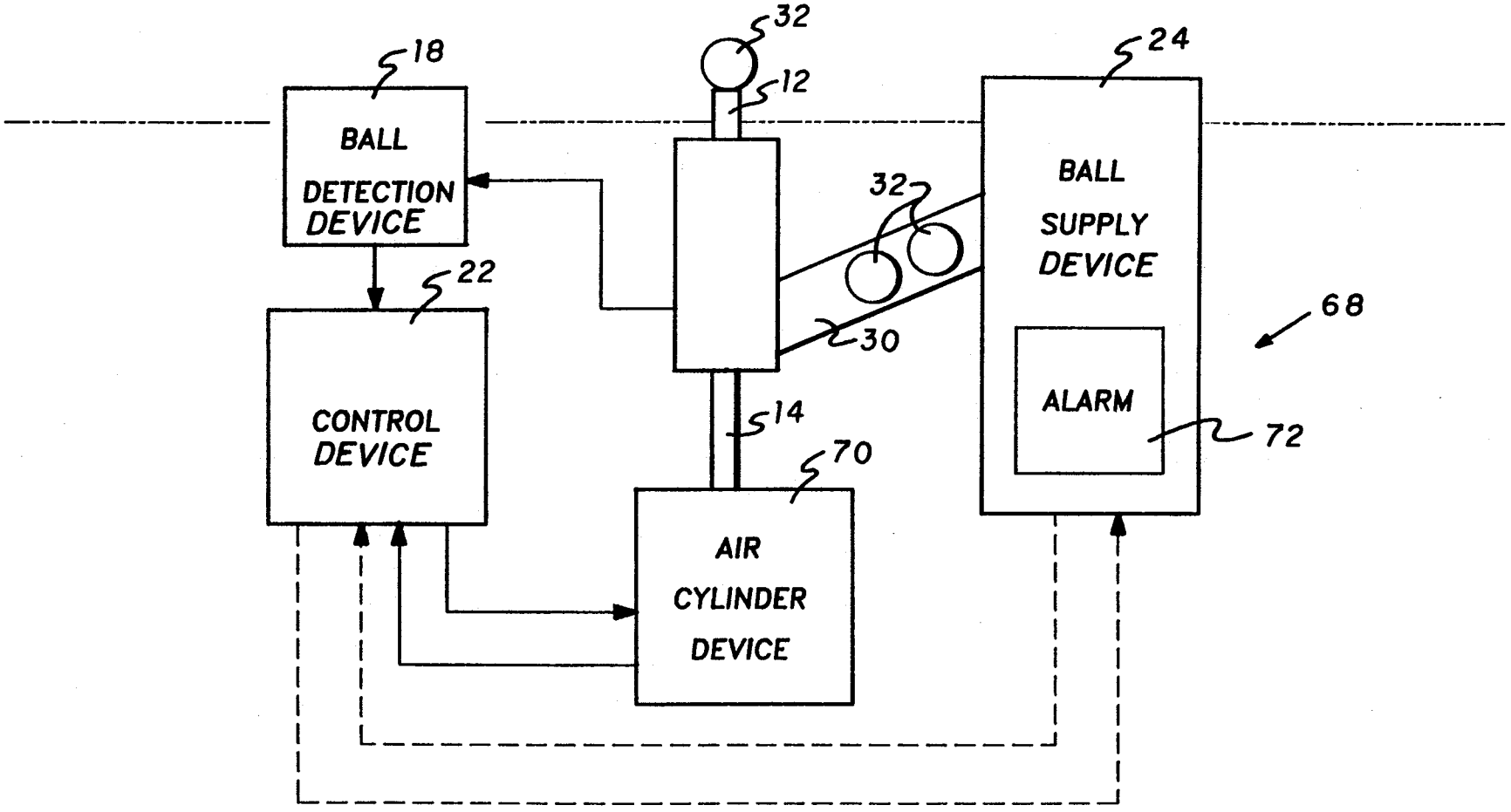
FIG. 5 shows a block diagram of a second embodiment of the automatic golf ball teeing apparatus.

First, a description will be given with reference to FIG. 1 of the principle of a first embodiment of the automatic golf ball teeing apparatus 10 according to the present invention. The automatic golf ball teeing apparatus 10 comprises a tee 12, a tee cylinder 14, a pivot linkage 16, a ball detecting device 18, a tee reciprocating device 20, a control device 22, and ball supply device 24 which may include a conventional alarm 72 as shown in FIG. 5. It is optional to include the ball supply device 24.

The tee 12 is coupled to the tee cylinder 14. The tee cylinder 14 is connected to one end of the pivot linkage 16. The other end of the pivot linkage 16 is connected to the tee reciprocating device 20. The ball detecting device 18 is connected to the control device 22. The tee reciprocating device 20 is further connected to the control device 22. Incidentally, the control device 22 may be connected to the ball supply device 24, as shown by broken lines in FIG. 1. In addition, the control device 22 may further be connected to an external monitoring device 26 which monitors the functionality of the automatic golf ball teeing apparatus 10. For example, the monitoring device 26 may be installed in a monitoring room of a driving range so as to monitor a plurality of automatic golf ball teeing apparatuses.

The tee 12 and the tee cylinder 14 longitudinally reciprocate inside a first passage 28. The first passage 28 is connected to the ball supply device 24 via a second passage 30. As shown in FIG. 2, the tee 12 can reciprocate by a length L1 between a first and second position A,B. When the tee 12 is located at the position A, a new ball 32 is supplied from the ball supply device 24 via the passage 30 and placed thereon. Therefore, the position A is located below a position C of the outlet of the passage 30. The tee cylinder 14 occludes the passage 30, while reciprocating, so as to prevent the passage 30 from supplying a ball 32 to the passage 30 except when the tee 12 is located at the position A. When the tee 12 is located at the position B, a golf ball 32 projects above the ground level so that a player (not shown) can hit the ball 32. The height above ground of the tee 12, indicated as L2 in FIG. 2, is adjustable as the player manipulates a lever or a button (not shown) connected to the control device 22, so that the player can drive a ball 32 from a desired height. Alternatively, the player may manually adjust the height of the tee 12. Incidentally, although the tee 12 has a cylindrical shape, it may be of another shape which will support a golf ball 32. In addition, the passage 28 has such a width D and a shape that each golf ball 32 can be appropriately placed on the tee 12. The tee cylinder 14 has a shape corresponding to that of the passage 28. In FIGS. 1 and 2, the passage 28 and the tee cylinder 14 each have a cylindrical shape.

The pivot linkage 16 functions as a transmission mechanism which transmits a force applied by the tee reciprocating device 20 to the tee 12 and the tee cylinder 14 and reciprocates the same. The pivot linkage 16 is operated by leverage, and thus includes a pivot pin 34 around which the pivot linkage 16 pivots. The pivot linkage 16 extends in a direction approximately orthogonal to a direction in which the tee 12 and the tee cylinder 14 reciprocate. As a result, the pivot linkage 16 can prevent the golf ball teeing apparatus 10 from extending in a longitudinal direction and facilitates in easy installation. Thus, the longer the automatic golf ball teeing apparatus 10 becomes in the longitudinal direction, the deeper the space becomes in which the automatic golf ball teeing apparatus 10 is buried, which is inconvenient for installing the automatic golf ball teeing apparatus 10 under ground.

The ball detecting device 18 detects whether or not a golf ball 32 is placed on the tee 12 and signals the control device 22 of that indication. The ball detecting device 18 may be incorporated with the tee 12 and/or the tee cylinder 14. The ball detecting device 18 may be comprised of the light sensor 36 shown in FIG. 4, which radiates a light beam toward the ball 32 to detect its existence, or a pressure sensor (not shown) which senses the pressure applied by the golf ball 32 to the tee 12.

The tee reciprocating device 20 applies the predetermined force to the other end of the pivot linkage 16 so as to reciprocate the tee 12 and the tee cylinder 14. Incidentally, when the player wants the tee 12 to become higher or lower, he or she may manipulate the lever or the button so as to instruct the control device 22 to make the tee reciprocating device 20 apply the predetermined force to the other end of the pivot linkage 16. The tee reciprocating device 20 comprises the air cylinder 38 and the solenoid valve 40 shown in FIG. 4 or alternatively, a vacuum pump and a cylindrical diaphragm (not shown). As yet another alternative, the tee reciprocating device 20 is comprised of a shaft, a gear, and a motor (also not shown). The shaft is connected to the other end of the pivot linkage 16 and has a geared surface, the gear would engages the geared surface of the shaft, and the motor is coupled to the gear to drive it. Thus, when the motor drives the gear, the gear rotates; the shaft moves the pivot linkage 16 and reciprocates the tee cylinder 14.

The control device 22 controls the operation of the tee reciprocating device 20 based on the detection result from the ball detecting device 18. Incidentally, the control device 22 may control the operation of the ball supply device 24. For example, when there is no golf ball 32 in the ball supply device 24, the ball supply device 24 may inform the control device 22 which may inform the player. Moreover, the tee reciprocating device 20 may be switched off if no golf balls 32 exist in the ball supply device 24. In addition, if the control device 22 is connected to the external monitoring device 26 in the monitoring room of the driving range and an operator in the monitoring room monitors a plurality of automatic golf ball teeing apparatuses 10, the control device 22 may trigger an alarm when a malfunction occurs.

The ball supply device 24 supplies a golf ball 32 to the passage 28 via the passage 30. The ball supply device 24 may be comprised of a tray (not shown) in which the player stocks a plurality of golf balls 32. Alternatively, the ball supply device 24 may be connected to a central ball stockroom (not shown) in which all of the golf balls of the driving range are stocked. The ball supply device 24 may include a microcomputer (not shown) by which the ball supply device 24 which retrieves the predetermined number of balls 32 from the central ball stockroom when the player inputs the predetermined number into the microcomputer. When there is no ball 32 in the ball supply device 24, the ball supply device 24 may inform the player.

Figure 2:
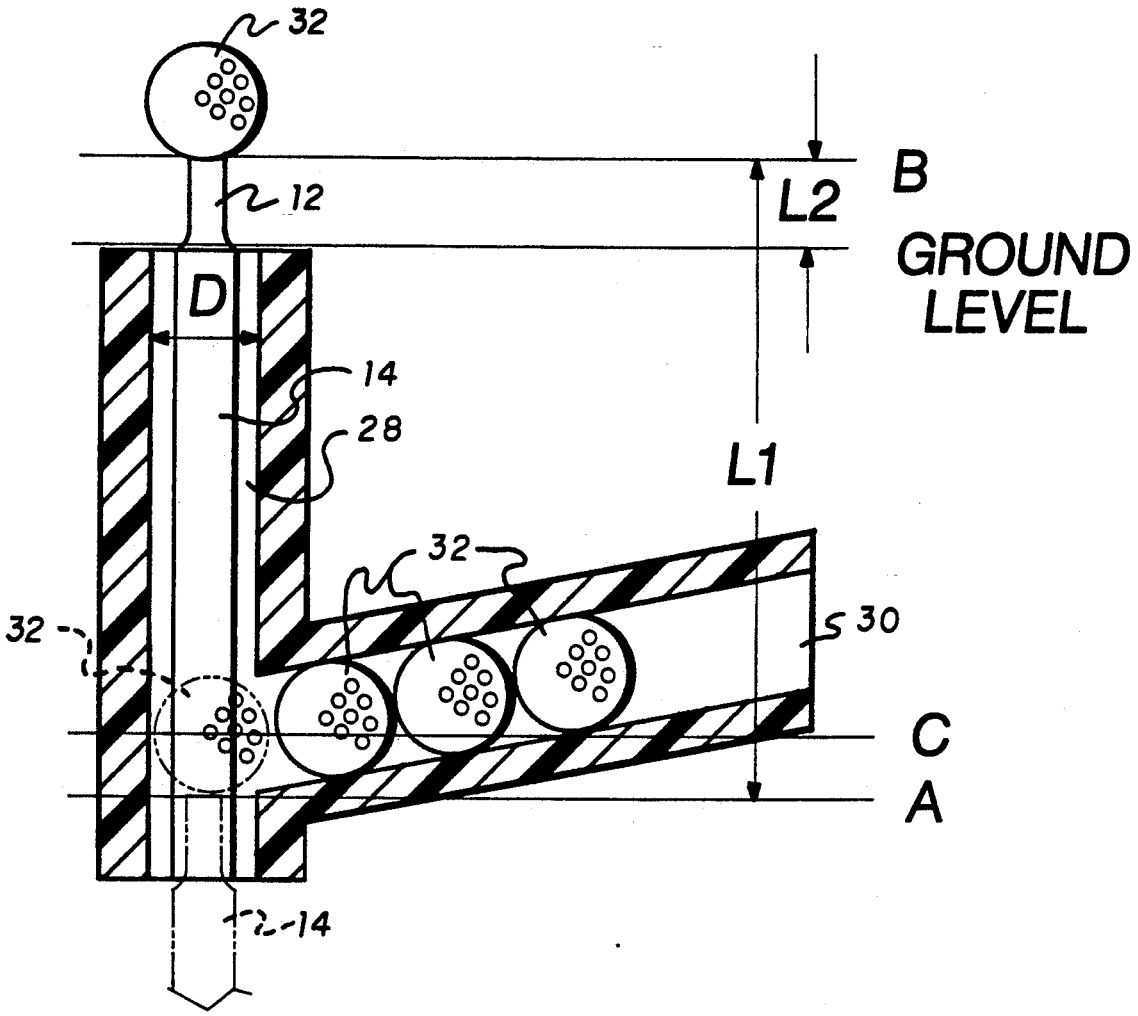
FIG. 2 shows a sectional view for explaining a reciprocating action of a tee shown in FIG. 1.
Figure 3:
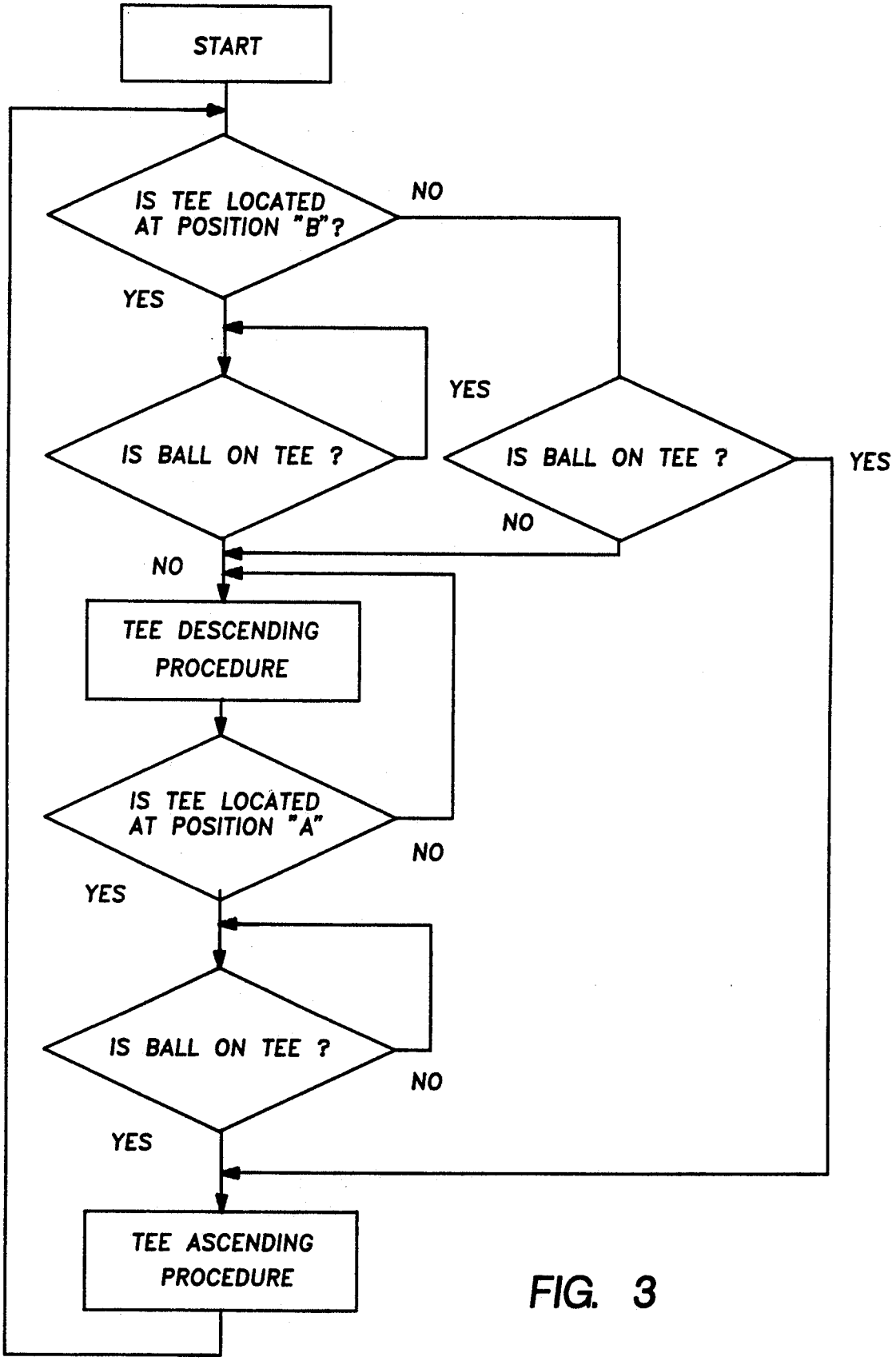
FIG. 3 shows a flowchart executed by the control device shown in FIG. 1.

Next follows, with reference to FIG. 3, the operation of the automatic golf ball teeing apparatus 10. In this example, it is assumed that when the automatic golf ball teeing apparatus 10 is energized, the tee 12 is located at the position A, position B, or in a middle position somewhere therebetween. First, the control device 22 judges whether or not the tee 12 is located at the position B shown in FIG. 2.

If the tee 10 is initially located at the position A or the middle position, the control device 22 judges whether or not a ball 32 is on the tee 12 based on the detection result of the ball detecting device 18. If the tee 10 is judged to have no ball 32, the control device 22 controls the tee reciprocating device 20 so that the tee 12 can descend to the position A. When the ball detecting device 18 detects a ball 32 supplied from the passage 30 to the tee 12 at the position A and informs the control device 22 of that, the control device 22 controls, in response, the tee reciprocating device 20 so that the tee 12 can ascend to the position B and the player can hit the ball 32.

If the tee 12 is initially located at the position B, the control device 22 judges whether or not a ball 32 is on the tee 12 based on the ball detecting device 18. If there is a ball 32 on the tee 12, the player can hit the ball immediately. After the player drives the ball from the tee 12 or if the tee 12 has no ball 32 initially, the control device 22 controls the tee reciprocating device 20 so that the tee 12 can descend to the position A. When the ball detecting device 18 detects a ball 32 supplied from the passage 30 to the tee 12 at the position A it informs the control device 22 of that condition. In response, the control device 22 controls the tee reciprocating device 20 so that the tee 12 can ascend to the position B.

During the driving practice, the procedure is supposed to flow from the start position. Thus, whenever the player hits a ball 32, the tee 12 descends to the position A so as to retrieve another ball 32, and then ascends to the position B so as to provide another ball 32 to be driven by the player. Needless to say, the flowchart shown in FIG. 3 is merely one example of the present invention.

Figure 4:
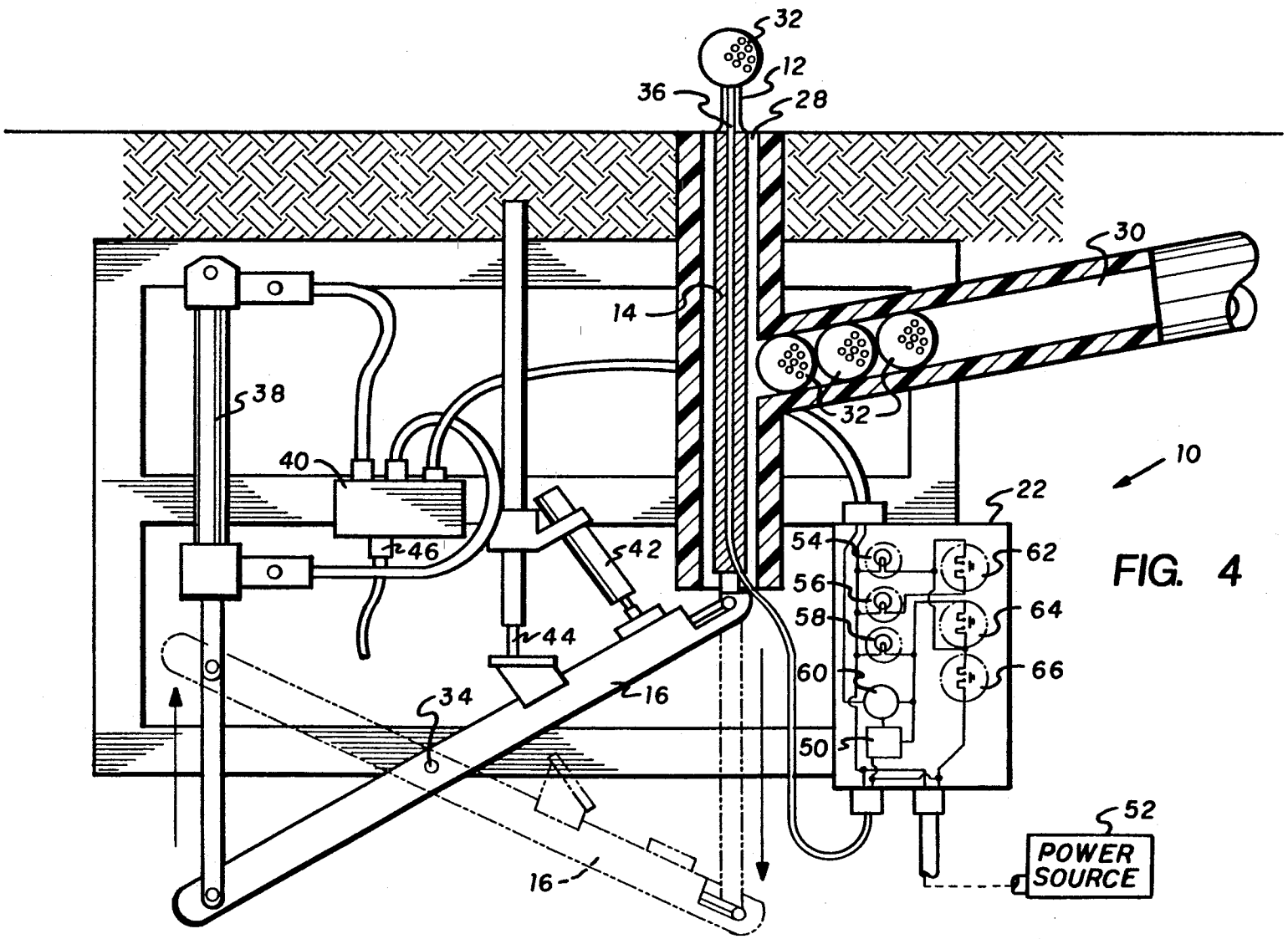
FIG. 4 shows a front elevational view of the automatic golf ball teeing apparatus shown in FIG. 1.

A description will be given, with reference to FIG. 4, of one example of the automatic golf ball teeing apparatus 10. The automatic golf ball teeing apparatus 10 comprises, as shown in FIG. 4, a flexible tee 12, a light sensor 36, a flexible tee cylinder 14, a shock absorber 42, a tee height adjuster 44, a pivot linkage or arm 16, an air cylinder 38, a line connection 46, passages 28 and 30, a control device or panel 22, and a solenoid valve 40. Incidentally, the ball supply device 24 shown in FIG. 1 is omitted from FIG. 4 for purposes of simplification.

The flexible tee 12 is coupled to the flexible tee cylinder 14. The light sensor 36 is accommodated in the flexible tee cylinder 14, and connected to a light sensor controller 50 in the control panel 22. The flexible tee cylinder 14 is accommodated in the passage 28 and is connected to one end of the pivot arm 16. The shock absorber 42 and the tee height adjuster 44 are connected to middle portions of the pivot arm 16. The other end of the pivot arm 16 is connected to the air cylinder 38. The air cylinder 38 is further connected to the solenoid valve 40, and the solenoid valve 40 is further connected to the control panel 22 and the air line connection 46.

Figure 1:
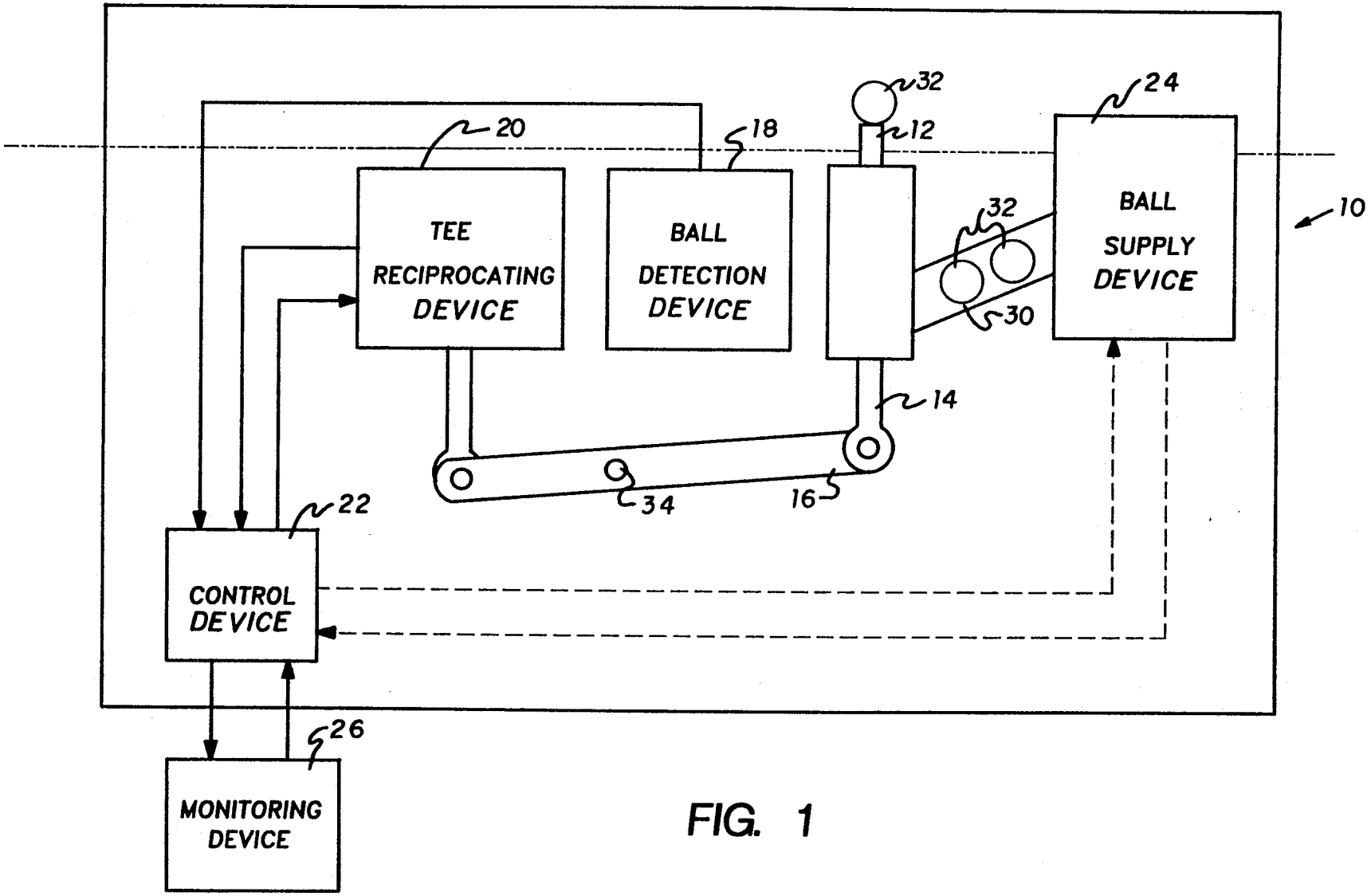
FIG. 1 shows a block diagram of a first embodiment of the automatic golf ball teeing apparatus.

The flexible tee 12 corresponds to the tee 12 shown in FIG. 1, and has a hollow shape. In addition, the flexible tee 12 is made of flexible material so as to absorb shock applied thereto by the player when hitting a ball.

The light sensor 36 corresponds to the ball detecting device 18 in FIG. 1, and radiates a light beam through the hollow flexible tee 12 to the outside. The light sensor 36 detects the existence of the ball 32 by judging whether or not the light beam is interrupted thereby.

The flexible tee cylinder 14 corresponds to the tee cylinder 14 shown in FIG. 1, and reciprocates with the tee 12 inside the passage 28. The flexible tee cylinder 14 is made of flexible material so as to absorb shock applied thereto by the player hitting a ball.

The shock absorber 42 absorbs shock applied to the pivot arm 16. The shock absorber 42 may be provided between the pivot pin 34 and the end of the pivot arm 16.

The tee height adjuster 44 adjusts the height of the tee 12, indicated by L2 in FIG. 2. In this embodiment, the tee height adjuster 44 fixes the height L2. However, as mentioned above, the tee height adjuster 44 may be connected to the control panel 22; when the player instructs the control panel 22 to somewhat ascend and/or descend the tee 12, the control panel 22 may instruct the tee height adjuster 44 to change the height L2. Alternatively, the player may manually change the height L2 via the tee height adjuster 44. The tee height adjuster 44 may be provided between the pivot pin 34 and the end of the pivot arm 16.

The pivot arm 16 corresponds to the pivot linkage 16 shown in FIG. 1, and pivots around the pivot pin 34. The pivot arm 16 transmits the force applied by the air cylinder 38, to the flexible tee cylinder 14. The air cylinder 38, the air line connection 46, and the solenoid valve 40 correspond to the tee reciprocating device 20 shown in FIG. 1. The solenoid valve 40 controls air supplied through the air line connection 46 to the air cylinder 38, which air activates the air cylinder 38. Since the air cylinder 38 is connected to the end of the pivot arm 16 opposite the flexible tee cylinder 14, the action of the pivot arm 16 and therefore, the reciprocating action of the flexible tee cylinder 14 is controlled by the solenoid valve 40. On the other hand, the operation of the solenoid valve 40 is controlled by the control panel 22.

The control panel 22 corresponds to the control device 22 shown in FIG. 1, and is connected to an external power source 52. The control panel 22 comprises a power light 54, a manual light 56, an auto light 58, a relay 60, a light sensor controller 50, a manual control switch 62, an auto/manual switch 64, and a power switch 66.

The power light 54 is connected to the power switch 66. The power light 54 indicates whether or not the power switch 66 is turned on. The power switch 66 is connected to the power source 52, and thus when the power switch 66 is turned on, power is supplied from the power source 52 to each part of the control panel 22. The manual light 56 is connected to the manual control switch 62 and indicates whether the manual control switch 62 selects the "manual" operation. When the "manual" operation is selected via the manual control switch 62, the manual control switch 62 should be turned on. Then the operations of the flexible tee cylinder 14 and thus the air cylinder 38 are controlled manually. The auto light 58 is connected to the auto/manual switch 64 and the light sensor controller 50, and indicates whether the auto/manual switch 64 selects the "automatic" operation. When the "automatic" operation is selected via the auto/manual switch 64, the operations of the flexible tee cylinder 14 and thus the air cylinder 38 are controlled automatically. The relay 60 is connected to the light sensor controller 50 and the solenoid valve 40 so as to control the solenoid valve 40. The light sensor controller 50 is connected to the light sensor 36, and controls the operation of the relay 60 based on the detection result transmitted from the light sensor 36.

Next follows, with reference to FIG. 4, a description of the operation of the golf ball teeing apparatus shown in FIG. 4. When a golf ball 32 is not present on the flexible tee 14, the light sensor 36 informs the light sensor controller 50 of the condition. In response, the light sensor controller 50 de-energizes the relay 60 which is a normally closed relay and thus, the relay 60 energizes the solenoid valve 40 so that the air cylinder 38 can retract. When the air cylinder 38 retracts, it draws the pivot arm 16 up toward the cylinder end and pulls the light sensor 36 and the flexible tee cylinder 14 down into the position A so that a golf ball 32 can be placed onto the top of the flexible tee 12, as shown in phantom. When the ball 32 is placed on the flexible tee 12, the light sensor 36 informs the light sensor controller 50. In response, the light sensor controller 50 energizes the relay 60 and thus the relay de-energizes the solenoid valve 40 so that the air cylinder 38 can release. Consequently, the flexible tee cylinder 14 is ascended via the pivot arm 16 and the flexible tee 12 and the ball 32 project above the ground, as shown in full view.

A description will now be given, with reference to FIG. 5, of a second embodiment of the automatic golf ball teeing apparatus 68. Those elements shown in FIG. 5 which are the same as corresponding elements shown in FIG. 1 are designated by the same reference numerals, and a description thereof will be omitted.

According to the golf ball teeing apparatus 68 of the second embodiment, an air cylinder device 70 is used for the tee reciprocating device 20 shown in FIG. 1. In addition, the pivot linkage 16 shown in FIG. 1 is omitted. The air cylinder device 70, comprises the air cylinder 38, the a line connection 46, and the solenoid valve 40 shown in FIG. 4. A similar construction is disclosed by U.S. Pat. No. 5,016,886 which uses a vacuum pump and a cylindrical diaphragm instead of the air cylinder 38 and the solenoid valve 40. However, the solenoid 40 is generally less expensive than the vacuum pump. In addition, a more precise control can be easily obtained by the solenoid 40 than by, the vacuum pump since it is generally difficult to appropriately adjust minute attraction force applied by the vacuum pump. Moreover, the vacuum pump is larger than the solenoid 40 and thus needs broader space than that of the solenoid 40. Further, as shown in FIG. 4, the air cylinder 38 and the solenoid valve 40 can be placed in parallel to each other. On the contrary, the vacuum pump is generally placed below the cylindrical diaphragm, as shown in U.S. Pat. No. 5,016,886, which prevents the teeing apparatus 10,68 from being easily installed under the ground. Incidentally, the operations of the golf ball teeing apparatus 68 shown in FIG. 5 is similar to that of the golf ball teeing apparatus 10 shown in FIG. 1, and a duplicate description will be omitted.

Further, the present invention is not limited to these preferred embodiments, and various variations and modifications may be made without departing from the scope of the present invention.

What is claimed is:

1. An apparatus for automatically teeing a golf ball, comprising:

a first passage;

a second passage, connected to said first passage, for supplying golf balls to said first passage;

a tee, accommodated in said first passage, for receiving and supporting a golf ball;

a tee cylinder, accommodated in said first passage and coupled to said tee, to reciprocate with said tee inside said first passage between a first position and a second position, whereby a golf ball is supplied from said second passage to said tee when said tee is located at said first position, said golf ball on said tee located at said second position being ready to be driven, said tee cylinder occluding said second passage, while reciprocating, so as to prevent said second passage from supplying a golf ball to said first passage except when said tee is located at said first position;

a pivot linkage having first and second ends, said first end of which is coupled to said tee cylinder, said pivot linkage extending in a direction approximately orthogonal to a direction in which said tee and said tee cylinder reciprocate;

ball detecting means for detecting whether or not a golf ball is placed on said tee;

pneumatic tee reciprocating means, coupled to said second end of said pivot linkage, for moving said second end of said pivot linkage and reciprocating said tee and said tee cylinder inside said first passage; and control means, coupled to said ball detecting means and said tee reciprocating means, for controlling operations of said tee reciprocating means based on a detection result from said ball detecting means whereby when a golf ball is removed from said tee, said tee automatically moves to said first position so as to receive another golf ball from said second passage and then moves to said second position.

2. The apparatus according to claim 1, wherein said tee has a hollow shape, and said ball detecting means comprises a light sensor accommodated in said tee cylinder whereby said light sensor radiates a light beam through said tee to the outside to detect a presence of a golf ball by judging whether said light beam is interrupted by a golf ball placed on said tee.

3. The apparatus according to claim 1, wherein said tee is made of flexible material.

4. The apparatus according to claim 1, wherein said tee cylinder is made of flexible material.

5. The apparatus according to claim 1, wherein said pneumatic reciprocating means comprises:

an air cylinder, coupled to said second end of first pivot linkage, which moves said first end of said pivot linkage and reciprocates said tee and said tee cylinder inside said first passage;

an air line connection coupled to said air cylinder, which supplies air to said air cylinder and moves said air cylinder; and a solenoid valve, coupled to said air cylinder, said air line connection and said control means, which controls operations of said air line connection, said control means controlling operations of said solenoid valve based on the detection result from said ball detecting means.

6. The apparatus according to claim 1, further comprising a shock absorbing means, connected to said pivot linkage, for absorbing shocks applied to said pivot linkage.

7. The apparatus according to claim 1, further comprising a tee height adjusting means, coupled to said pivot linkage, for changing said second position of said tee.

8. The apparatus according to claim 7, wherein said tee height adjusting means is connected to said control means, and said control means instructs said height adjusting means to change said second position of said tee.

9. The apparatus according to claim 1, further comprising ball supply means, coupled to said second passage, for supplying a plurality of golf balls to said second passage.

10. The apparatus according to claim 9, wherein said ball supply means further includes an alarm means for signaling an operator of said apparatus when a condition exists where there is no golf ball in said ball supply means.

11. The apparatus according to claim 9, wherein said ball supply means is connected to said control means, and when a condition exists where there is no golf ball in said ball supply means, said ball supply means informs said control means of that condition and, in response, said control means informs an operator of said apparatus of that condition.

12. The apparatus according to claim 1, wherein said control means is further connected to an external monitoring device which monitors whether said apparatus is functioning properly whereby when a malfunction occurs, said control means informs said monitoring device of the malfunction.

13. An apparatus for automatically teeing a golf ball, comprising:

a first passage;

a second passage, connected to said first passage, for supplying golf balls to said first passage;

a tee, accommodated in said first passage, for receiving and supporting a golf ball;

a tee cylinder, accommodated in said first passage and coupled to said tee, which can reciprocate with said tee inside said first passage between a first position and a second position, whereby a golf ball is supplied from said second passage to said tee when said tee is located at said first position, said golf ball on said tee located at said second position being ready to be driven, said tee cylinder occluding said second passage, while reciprocating, so as to prevent said second passage from supplying a golf ball to said first passage except when said tee is located at said first position;

a pivot linkage having first and second ends, said first end of which is coupled to said tee cylinder, said pivot linkage extending in a direction approximately orthogonal to a direction in which said tee and said tee cylinder reciprocate;

ball detecting means for detecting whether or not a golf ball is placed on said tee;

an air cylinder, coupled to said second end of said pivot linkage, which moves said second end of said pivot linkage and reciprocates said tee and said tee cylinder inside said first passage;

an air line connection coupled to said air cylinder, which supplies air to said air cylinder and moves said air cylinder;

a solenoid valve, coupled to said air cylinder and said air line connection, which controls operation of said air line connection; and control means, coupled to said ball detecting means and said solenoid valve, for controlling operations of said solenoid valve based on a detection result from said ball detecting means whereby when a golf ball is removed from said tee, said tee automatically moves to said first position so as to receive another golf ball from said second passage and then moves to said second position.

14. The apparatus according to claim 13, wherein said control means is further connected to an external monitoring device which monitors whether said apparatus is functioning properly whereby when a malfunction occurs, said control means informs the monitoring device of the malfunction.

* * * * *